US005826505A

United States Patent [19]

Volz et al.

[11] Patent Number: 5,826,505

[45] Date of Patent: Oct. 27, 1998

[54] DRIVE FOR A PRINTING PRESS

[75] Inventors: Albrecht Volz, Rodermark; Joachim Blumor, Hainburg; Holger Wiese, Obertshausen; Klaus-Peter Reichardt, Bad Vilbel; Helmut Schild, Steinbach/Ts, all of Germany

[73] Assignee: MAN Roland Druckmaschinen AG, Germany

[21] Appl. No.: 872,693

[22] Filed: Jun. 11, 1997

[30] Foreign Application Priority Data

Jun. 11, 1996 [DE] Germany ..... 196 23 224.4

[51] Int. Cl.[6] ..... B41F 5/10

[52] U.S. Cl. ..... 101/183; 101/181; 101/216; 101/350

[58] Field of Search ..... 101/181, 183, 101/216, 248, 182, 184, 185, 217, 152, 153, 141, 348, 349, 350

[56] References Cited

U.S. PATENT DOCUMENTS

| | | | |
|---|---|---|---|
| 4,125,073 | 11/1978 | Bain | 101/216 |
| 4,852,785 | 8/1989 | Bettendorf et al. | 101/181 |
| 5,080,012 | 1/1992 | Fischer et al. | 101/183 |
| 5,152,224 | 10/1992 | Guaraldi et al. | 101/350 |
| 5,377,585 | 1/1995 | Kipphan et al. | 101/181 |
| 5,377,589 | 1/1995 | Kruger et al. | 101/248 |
| 5,595,117 | 1/1997 | Chrigui | 101/216 |

FOREIGN PATENT DOCUMENTS

| | | |
|---|---|---|
| 475 1201 | 8/1991 | European Pat. Off. . |
| 41 02 472 A1 | 8/1992 | Germany . |
| 42 41 807 A1 | 6/1994 | Germany . |
| 2 253 592 | 9/1992 | United Kingdom . |

*Primary Examiner*—Christopher A. Bennett
*Attorney, Agent, or Firm*—Leydig, Voit & Mayer, Ltd.

[57] ABSTRACT

A drive is provided for a sheet-fed offset printing press having multiple printing units. Each printing unit has printing cylinders which are independently driven. Transfer drums are driven mechanically uncoupled from the printing cylinders, and may be interconnected by a single gear train, or the transfer cylinders of each printing unit may be independently driven by a respective drive. Other rollers in the printing units may have individual controllable drives also. The invention minimizes disturbances caused by load fluctuations in conventional printing presses wherein the printing and transfer systems are mechanically intercoupled. The invention also is cost effective, particularly for register corrections. According to the invention, at least the plate cylinders are driven individually with respect to the sheet-transfer system or the corresponding blanket cylinder.

18 Claims, 5 Drawing Sheets

DRIVE FOR A PRINTING PRESS

FIELD OF THE INVENTION

The invention generally relates to a drive for a printing press, and more particularly to a drive system in which rotatable printing components are drivable separately from rotatable sheet-transfer components.

BACKGROUND OF THE INVENTION

In sheet-fed offset printing presses, the sheets to be printed are taken from the top side of a stack and conveyed via a feed table to a feeder. There, the registered sheets are gripped, for example, by a pregripper, accelerated to match the circumferential speed of the rotating cylinders and transferred to a first printing unit cylinder. The sheets are transported within and between adjacent individual printing units by impression cylinders, transfer cylinders or drums. Downstream of a last printing unit or a final finishing device (e.g., a varnishing device or the like), the sheets are deposited on the top side of a delivery stack.

Conventionally, such sheet-fed offset printing presses have a continuous gear train by means of which the printing unit cylinders and the transfer cylinders or transfer drums arranged between the printing unit cylinders are coupled to one another. The feeder and deliverer are usually also coupled to the gear train, although in most systems the feeder is disengagable by a switchable clutch. In printing presses of this type, the required drive energy is fed in at one or more feed points by one or more drive motors (usually DC motors).

In sheet-fed offset printing presses, the cylinders serving the purpose of sheet transport, the printing unit cylinders, feeder, and deliverer each imparts a different drive load, each subjecting the system to a particular load torque that depends substantially on the position of the part respectively being moved. For sheet transport cylinders, this fluctuating load is caused by the operation of the controlled gripper systems which hold and release the sheets. The blanket cylinder/plate cylinder systems and the blanket cylinder/impression cylinder systems are likewise subjected to strong load fluctuations because of the printing zone contact which builds up and subsides periodically. The feeder and deliverer sheet transport systems of a sheet-fed offset printing press also create nonuniform loads. Nonuniform disturbances also produce a load torque at the ink feed point, because the ink feed is typically performed by an intermittent vibrator roller which transfers ink from an ink duct roller to the remaining ink rollers of the inking unit by temporary contact with a first ink distribution roller.

Some of these problems are solved in a drive disclosed in German patent publication DE 41 02 472 Al, wherein the main drive of the printing press is divided in such a way that the feeder and deliverer sheet transport units are operated by separate individual drives. Synchronization with the printing unit drives is performed electronically. However, this device avoids only the periodic load fluctuations which are caused by feeder and deliverer. The load fluctuations and disturbances caused by the printing units, the feed-transfer means, and by the inking units are not eliminated, nor are their effects reduced.

German patent publication DE 42 41 807 Al discloses a drive for a printing press in which sheet transport cylinders, printing unit cylinders, and in particular, the plate cylinders have a continuous gear train and are driven from at least one drive motor. The elements which do not serve the purpose of sheet transport, particularly the inking units, are driven by separate drive motors. Synchronization of the mutually decoupled subsystems is performed by a controller which detects sensor signals corresponding to kinetic quantities. This device does avoid the negative effects on the printing process of the torque fluctuations produced by the cooperation of the vibrator roller with a first inking unit roller (distribution roller) in the inking unit, however, it is disadvantageous in that the plate cylinder is mechanically connected to the continuous gear train of the remaining printing unit cylinders. As a result, load fluctuations are transmitted directly onto the plate cylinder and cause corresponding disturbances. This device is also disadvantageous in that in the case of a multi-color sheet-fed offset printing press, the plate cylinders must be equipped with complicated mechanical devices for circumferential, lateral and/or oblique register correction. Moreover, in the case of plate cylinders coupled directly to the remaining printing unit cylinders, it is necessary to detach the corresponding printing plates from the plate cylinder and to remount them after loading stronger packing sheets for printing length compensation (printing length correction). Such manipulations are very time consuming and require great skill on the part of the operating personnel who execute them.

European Patent reference EP 0 475 120 Al discloses a high-speed ink feeding mechanism where, in the case of a vibrator type inking unit, the first inking unit roller (distribution roller) downstream of the vibrator roller has a dedicated drive. This prevents the load torque of the vibrator roller from acting negatively on the rotation of the plate cylinder. However, this device is disadvantageous because, in addition to the need for a separate drive for the first inking unit roller, it is necessary to provide additional drives in the inking unit downstream of the vibrator roller (distribution roller). Again, the inking unit described is capable only of eliminating printing disturbances caused by the movement of the vibrator rollers, but not those influences which are caused by the sheet transport mechanism.

OBJECTS AND SUMMARY OF THE INVENTION

It is therefore an object of the present invention to provide a drive for an improved printing press which overcomes the above-mentioned disadvantages, and which provides a drive system that cost-effectively minimizes printing disturbances.

In accordance with an embodiment of the invention, the sheet transport cylinders or drums are driven by a continuous gear train, as a whole or in groups, by at least one drive motor. Also, at least the plate cylinder in each printing unit has an individual drive which is decoupled from the cylinders assigned to the sheet transport. Moreover, in an embodiment, the drive connected to the plate cylinder may drive the plate cylinder and the inking unit rollers directly in contact with it, as well as the inking unit rollers downstream of these plate inking rollers, down to the first distribution roller. In this embodiment, the blanket cylinder cooperating with the plate cylinder is coupled to the gear wheel of the respective impression cylinder, and the blanket cylinders in the individual printing units are provided with additional individual drives which exert an appropriate braking torque on the blanket cylinders to which they are connected to prevent tooth surface changes. The first inking unit roller, or distribution roller, downstream of the ink vibrator roller in the respective inking units of the printing units also has, moreover, one respective individual drive.

In the above-described embodiment of the present invention, the sheet transport cylinders or drums have a continuous gear train which can be driven by at least one drive. Additionally, in the respective printing units, the blanket cylinders are in toothed engagement with the assigned impression cylinders. As mentioned, the individual blanket cylinders have individual drives by means of which braking torques are generated to provide constant tooth surface contact. The plate cylinders are mechanically decoupled from their respective blanket cylinders and each has an individual drive. In this case, the blanket cylinders have respective position sensors delivering signals to control the drives of the plate cylinders for synchronous angular variation with the associated blanket cylinders.

In the embodiment, the power flow into the sheet transport cylinder or drum system may be separate in accordance with the number of the printing units. In such a case, each printing unit comprises, for example, an impression cylinder as well as an upstream and/or downstream transfer drum or a feed drum, both the impression cylinder and the transfer cylinder or drum being coupled to one another by a gear train. The essence of this embodiment is that there is no mechanical coupling between the multiple printing units so that the power flow of the cylinders or drums effecting the sheet transport is restricted to the gear train within a particular printing unit. The blanket cylinders of each printing unit may also be coupled via gear wheels to the assigned impression cylinder, these having a dedicated drive for generating a constant tooth surface contact. The plate cylinders in the printing units are mechanically decoupled from the respective blanket cylinders and are driven by individual drives, synchronized with sensor signals from the respective blanket cylinders. In this embodiment, the inking unit of each printing unit has an individual drive for the duct roller, an individual drive for the first inking unit roller or distribution roller downstream of the vibrator roller. Of course, even more inking roller drives are possible.

A common feature of the above embodiments of the invention is that the blanket cylinders associated with the respective individual printing units are driveably connected to the respective impression cylinder. The individual drives for the blanket cylinders either serve to feed a corresponding braking torque to maintain a constant surface contact of the gear drive between the blanket cylinder and:

(a) an impression cylinder which has at least one dedicated drive; or (b) the drive of the sheet transfer system which has a continuous or split-up gear train having no dedicated drive.

Due to the constant tooth surface contact in the gear drive between the blanket cylinder and impression cylinder (case (a) above), disturbance is minimized in the image transfer between the blanket and the printed sheet guided on the printing carrier cylinder.

In the above-described embodiment wherein the plate cylinder of each respective printing unit is driven in a mechanically decoupled fashion by an individual drive to the exact angular position and synchronously with the respective blanket cylinder, it is also possible to undertake lateral and/or circumferential register correction by relatively simple mechanical means. For a lateral register correction device the respective plate cylinder must be mounted, together with the corresponding drive, on the side frame walls such that it can be displaced only in the axial direction. This eliminates the conventional structurally complicated means for such an adjustment. A register correction in the circumferential direction is achieved by a simply inserting a phase shift in the angular synchronism between the plate cylinder and blanket cylinder. Since there is no mechanical coupling between these cylinders, this is performed purely through electronic control.

In another preferred embodiment of the invention, the printing carrier transport cylinders or drums are coupled to one another by a common gear train. In the individual printing units, the blanket cylinders and plate cylinders are respectively coupled to one another by a gear wheel pair, but decoupled from the assigned impression cylinder, and can be driven from a dedicated individual drive. Each impression cylinder has an angle sensor whose signals are evaluated for controlling the synchronism of the blanket cylinder relative to the impression cylinder with the blanket cylinder/plate cylinder drive motor. This drive motor is preferably coupled directly to the gear wheel of the blanket cylinder which meshes with the corresponding gear wheel of the plate cylinder. In this case, as well, there is no feedback of the load fluctuations from the gear train which guides the printing carrier to the printing unit cylinders (blanket cylinders and plate cylinders).

In a similar manner, circumferential register correction and lateral register correction can also be accomplished by means of the present invention. An adjusting device for the lateral register permits adjusting or displacing the assembly of the plate cylinder and the blanket cylinder. A means for correcting the circumferential register is also accomplished by electronically prescribing an appropriate phase relationship for the synchronism between the impression cylinder and blanket cylinder or plate cylinder. In this case as well, at least the first inking unit roller or distribution roller downstream of the vibrator roller is provided with an individual drive.

In addition to the possibilities indicated for making printing corrections (e.g., circumferential register, printing-length compensation), the plate cylinders, which can be driven individually and independently of the remaining cylinder system, also enable further operations, such as plate changing or cylinder washing, with a higher degree of flexibility. It is therefore possible during a printing operation with the blanket cylinder disconnected (with respect to the plate cylinder) to use appropriate devices in idle printing units or in all printing units for the purpose of simultaneously changing the printing plates of the plate cylinders semiautomatically or fully automatically and, in addition, driving the plate cylinders in the manner provided. It is also possible to use the drive system to carry out a "flying plate change" in a sheet-fed printing press at a reasonable cost.

These and other features and advantages of the invention will be more readily apparent upon reading the following description of preferred embodiments of the invention and upon reference to the accompanying drawings wherein:

While the invention will be described in connection with certain preferred embodiments, there is no intent to limit it to those embodiments. On the contrary, the intent is to cover all alternatives, modifications, and equivalence included within the spirit and scope of the invention as defined by the appended claims.

DETAILED DESCRIPTION OF THE DRAWINGS

Referring now more particularly to the Figures, various exemplary embodiments are described below in conjunction with FIGS. 1–5.

Figure 1:
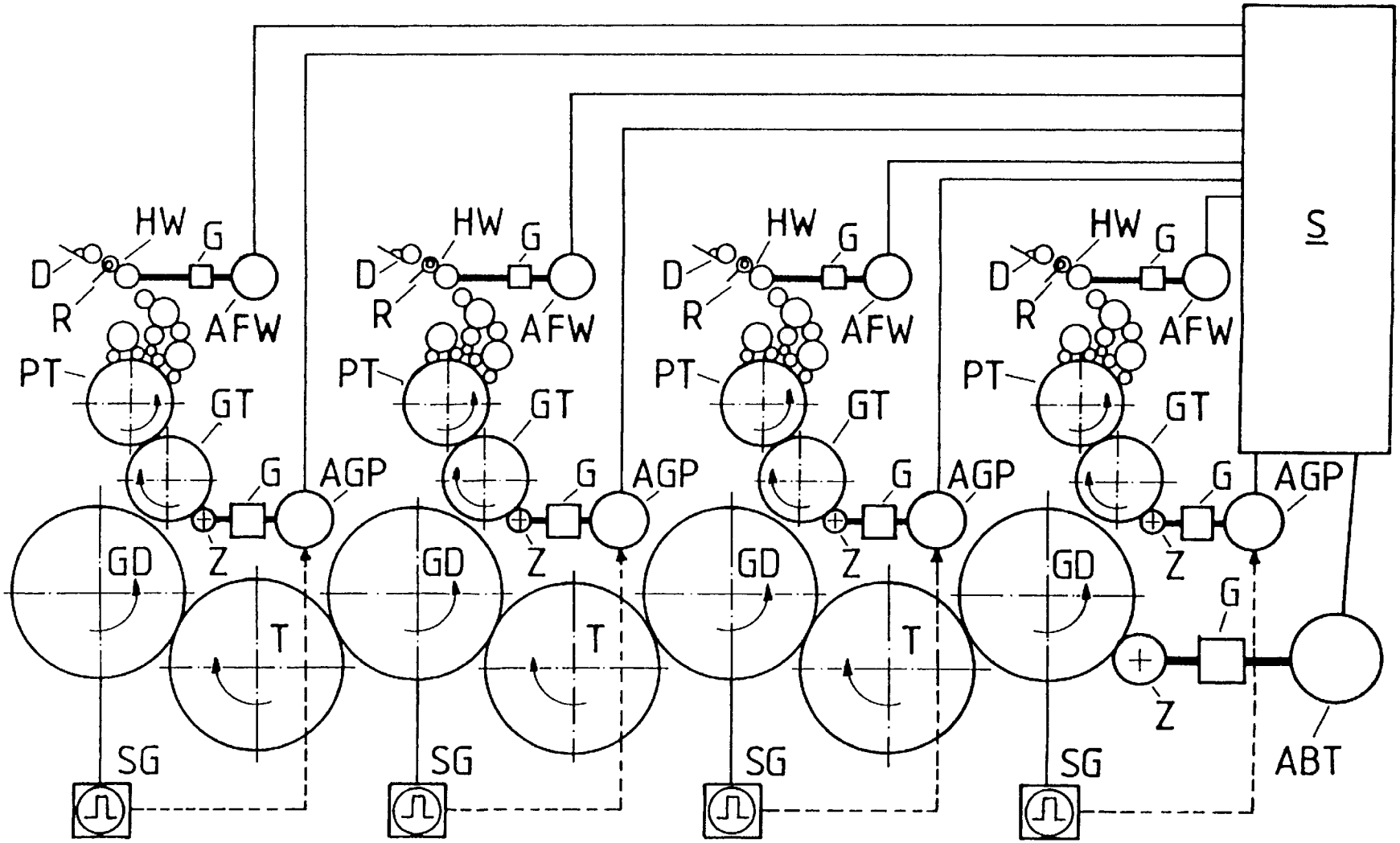
FIG. 1 is a diagrammatic side view of a printing press incorporating the features of the present invention.

A first of these is illustrated in FIG. 1 which shows a four-unit printing press having impression cylinders GD and sheet transfer drums T, arranged therebetween. These impression cylinders GD and the transfer drums T are driveably coupled to one another, among the printing units, by a continuous gear train. The impression cylinders GD and the transfer drums T are driven by a drive motor ABT via a gear reducer G and a gear wheel Z, which meshes with the gear wheel of the impression cylinder GD of the first printing unit.

According to the invention, the plate cylinders PT and the blanket cylinders GT in the individual printing units respectively run in a fashion decoupled from the associated impression cylinders GD, with no gear wheel interconnection. However, in the embodiment of FIG. 1, each plate cylinder PT is interconnected to its respective blanket cylinder GT by a gear wheel pair. Each plate cylinder PT and blanket cylinder GT combination is driven, in each individual printing unit, by a drive motor AGP via a gear wheel Z meshing with the gear wheel of the blanket cylinder GT and a gear reducer G. The blanket cylinders GT and the plate cylinders PT cooperating therewith are mounted adjustably on the frame walls (not shown) of the printing press for the purpose of achieving lateral register correction and, if appropriate, oblique register correction. As an alternative to the possibility of adjusting the oblique register of the system of plate cylinder PT/blanket cylinder GT, the transfer drums T can also be mounted pivotably with respect to the impression cylinders GD in a known manner.

As shown diagrammatically in FIG. 1, for the purpose of achieving a highly accurate angular synchronism between the blanket cylinders GT and the associated impression cylinders GD, each of the impression cylinders GD has a sensor SG, which can be an absolute or incremental encoder. Preferably, the signals from the sensors SG enable the determination of corresponding controlled variables of the impression cylinders GD in individual printing unit controllers assigned to the drive motors AGP of the individual printing units. Examples of such printing unit controllers are shown in greater detail FIGS. 4 and 5. The signals of the sensors SG of the impression cylinders GD are thus evaluated with respect to a synchronism of the blanket cylinders GT (plate cylinders PT) with respect to the impression cylinders GD as driven by the individual drives AGP. Additionally, in the preferrred printing unit controller of FIG. 4, motor sensors also deliver a feedback signal which is evaluated in controlling the particular drives. The alternative printing unit controller shown in FIG. 5 can be used in an alternative printing press of the invention in which printing unit drive motors are DC stepping motors, each having a finite predetermined output for a given control input signal. Alternatively, a further individual printing unit controller is disclosed in U.S. Ser. No. 08/872,847 (Filed Jun. 11, 1997, Attorney Docket No. 78627, Entitled "Drive for a Printing Machine", Inventors: Albrecht Volz; Joachim Blumor, Holger Wiese, and Klaus-Peter Reichhardt), incorporated herein by reference.

For generating an intermittent movement between the duct roller D and an immediately-downstream distribution roller R, an individual drive (not shown) is provided for each of the duct roller D and another drive for the vibrator roller HW in each printing unit. In the exemplary embodiment of FIG. 1, a drive AFW is provided, in each printing unit, to the distribution roller R via a gear reducer G, with the result that the distribution rollers R can be driven at prescribable speeds, possibly with slip, with respect to the remaining inking unit rollers. In addition, further inking unit rollers, of the indicated inking units, can also have individual controllable drives, but alternatively, specific inking unit rollers may be connected via gear trains to respective their plate cylinders PT.

A higher-level controller S is operationally connected to the drives AFW of the distribution rollers R, the drives AGP of the blanket cylinder GT/plate cylinder PT systems (individually driven in the printing units), the drive ABT for the sheet transport of the continuous gear train of the impression cylinders GD, and the transfer drums T. The nature of the control concept is such that the individual blanket cylinder GT/plate cylinder PT systems run, via their respectively assigned drives AGP, in an angularly synchronous fashion, directly via the sensors SG of the assigned impression cylinders GD, while the drives AFW of the distribution rollers R in the individual printing units follow correspondingly prescribable values of the kinetic quantities in the individual printing units. Since the drive ABT of the sheet-guiding system of the impression cylinders GD and of the transfer drums T are also connected to the controller S, it is possible to prescribe freely selectable desired speed values.

Figure 2:
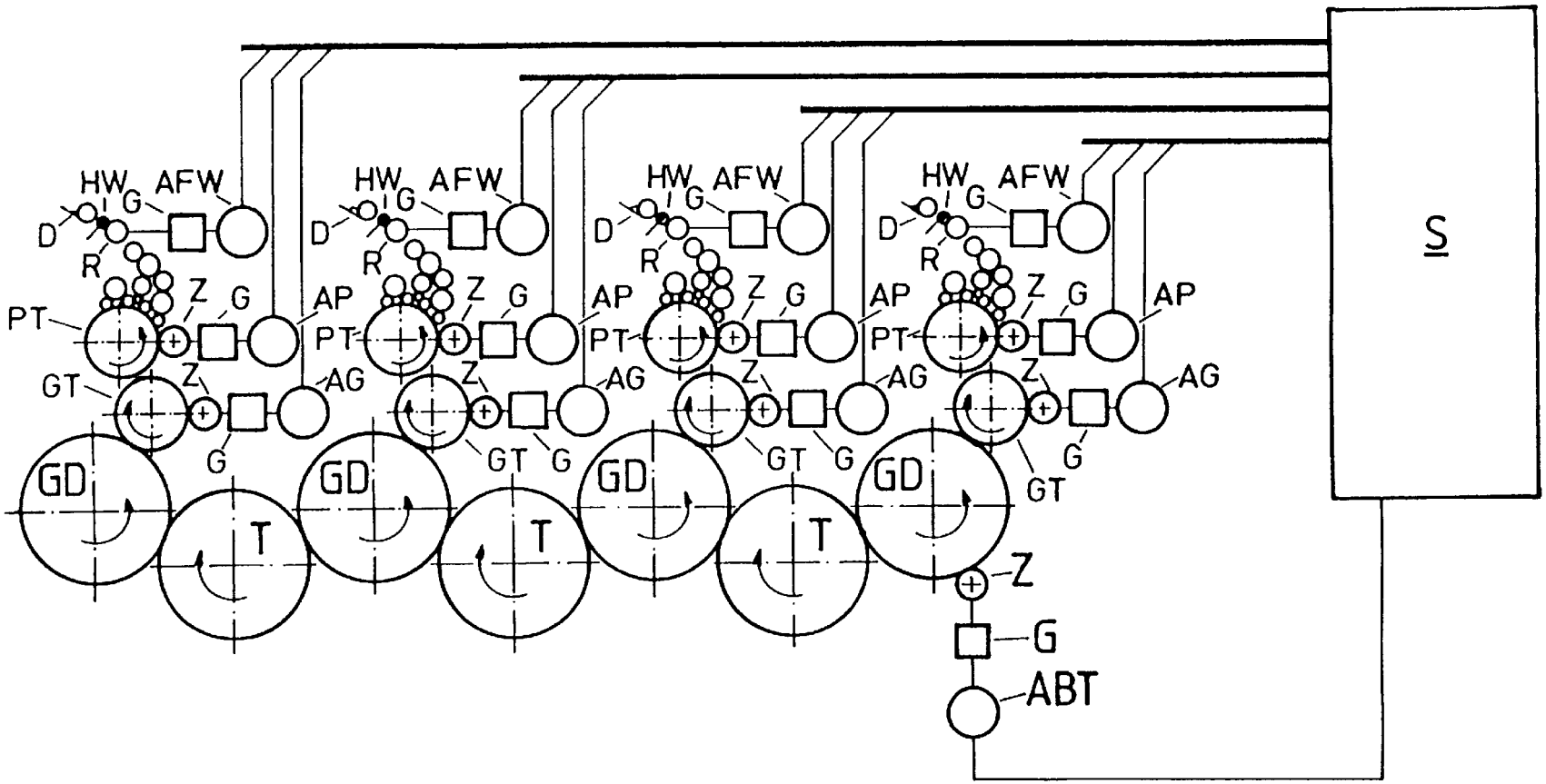
FIG. 2 is a diagrammatic side view of another embodiment of a printing press incorporating features according to the present invention.

FIG. 2 shows a second exemplary embodiment of a sheet transport system which, similar to the embodiment described above in connection with FIG. 1, has a plurality of impression cylinders GD alternatingly arranged in a continuous gear train with a plurality of transfer drums T. Also in the embodiment of FIG. 2, the drive of this sheet transport system is performed via a drive ABT and a downstream gear reducer G by means of a gear wheel Z which meshes with the respective gear wheel of the impression cylinder GD of the first printing unit. In this exemplary embodiment, the blanket cylinders GT are connected via a gear wheel pair to the sheet-transfer system, i.e., the respective impression cylinders GD of the individual printing units. In addition, the blanket cylinders GT in the individual printing units have individually controllable drives AG which are connected via a gear reducer G and a downstream gear wheel Z to the respective gear wheel of the blanket cylinder GT. By stipulating appropriate control variables, the respective drives AG of to the blanket cylinders GT, achieve a constant tooth surface contact of the gear wheel pairs between the blanket cylinder GT and the impression cylinder GD by providing a prescribed braking torque. The plate cylinders PT in the individual printing units are mechanically decoupled from one another and are driven at angular synchronism with respect to the assigned blanket cylinder GT via a gear wheel Z, which meshes with the respective gear wheel of the plate cylinder PT, and a gear reducer G of the assigned drive AP. As in the first exemplary embodiment, the distribution rollers R, in the individual printing units, each have a drive AFW. The same holds for the duct roller D and the vibrator rollers HW.

According to this second exemplary embodiment of FIG. 2, the plate cylinders PT are individually driven and are isolated from the blanket cylinders GT and the impression cylinders GD of the sheet-transfer system. By stipulating appropriate control variables of a higher-level controller S, in which it is also possible to combine the DC link, the plate cylinders PT can be driven, in particular, with regard to the correction of printing length differences or the register. The controller embodiments shown in FIGS. 4 and 5 could also be used in conjunction with FIG. 2. As indicated in FIGS. 2, 4 and 5, the drives ABT, AG, AP and AFW are all connected to the controller S, with the result that it is possible to execute appropriate control commands aimed at angular synchronism or deliberate deviation from angular synchronism or envisaged speed differences in the respectively driven systems.

Figure 3:
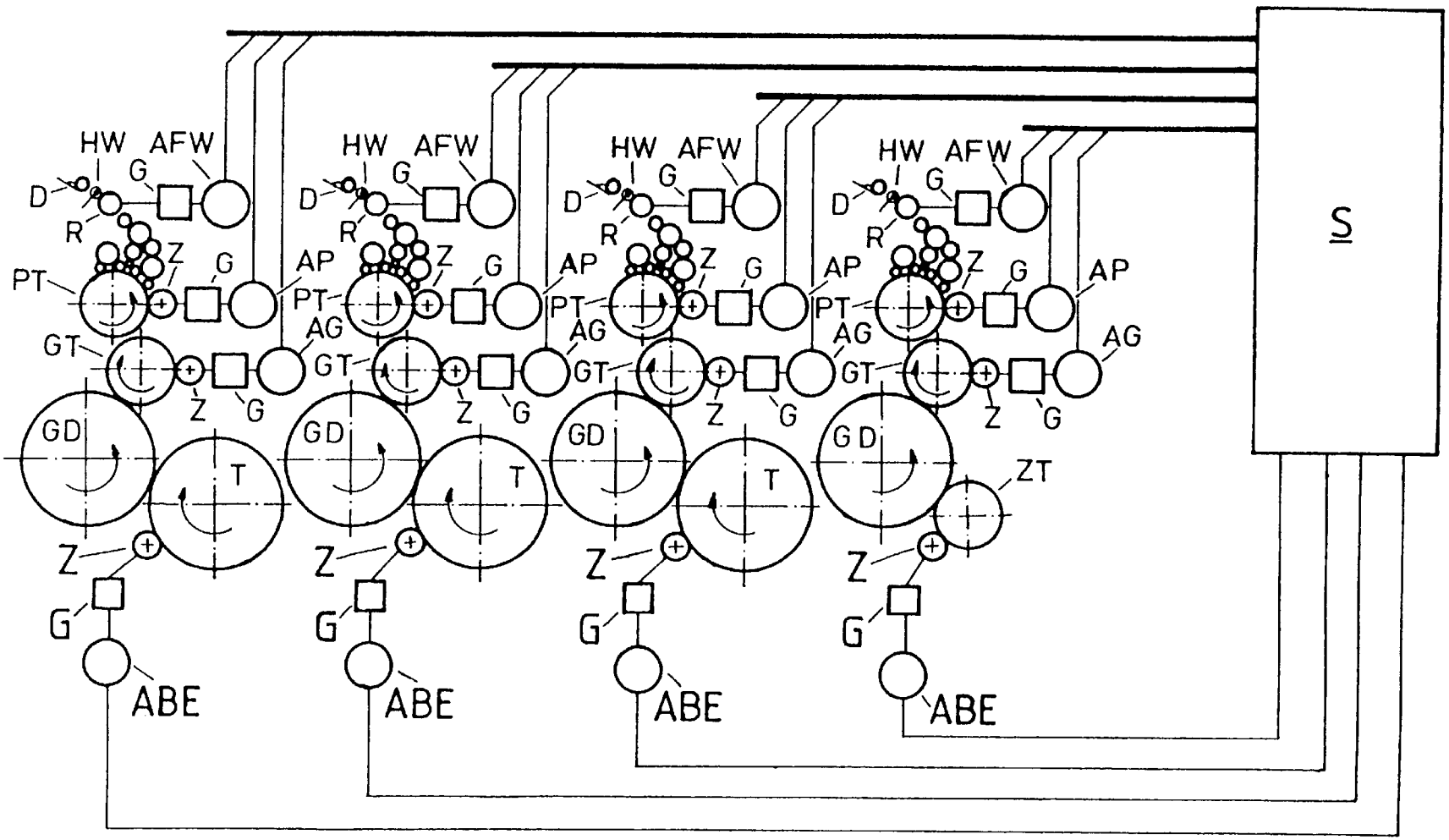
FIG. 3 is a diagrammatic side view of yet another embodiment of a printing press having features according the present invention.

In accordance with a third exemplary embodiment of the invention, as shown in FIG. 3, there is no mechanical coupling among the separate printing units. In contrast to the first and second exemplary embodiments described above, in the embodiment of FIG. 3, the sheet-transfer cylinders (i.e., the individual impression cylinders GD and the transfer drums T arranged therebetween) are not commonly driven by a continuous gear train. Rather, according to this third embodiment, the impression cylinders GD and the associated transfer drums T are connected to one another by gearing only within an individual printing unit, but there is no mechanical coupling of these elements to those of adjacent printing units.

As shown in FIG. 3, in each unit, each impression cylinder GD and associated transfer drum T are connected to an individual drive ABE. In each unit, the drives ABE drive the gear wheels of the transfer drums T via a gear reducer G and corresponding gear wheels Z (as in exemplary embodiment 2), and thereby drive impression cylinder GD. For the first printing unit, the drive ABE drives feed drum ZT, positioned upstream of the impression cylinder GD. Sheets are fed from a feeder (not shown) to this first printing unit via the feed drum ZT. Like the transfer drums T, the feed drum ZT is also connected to the impression cylinder GD by toothed engagement.

Figure 4:
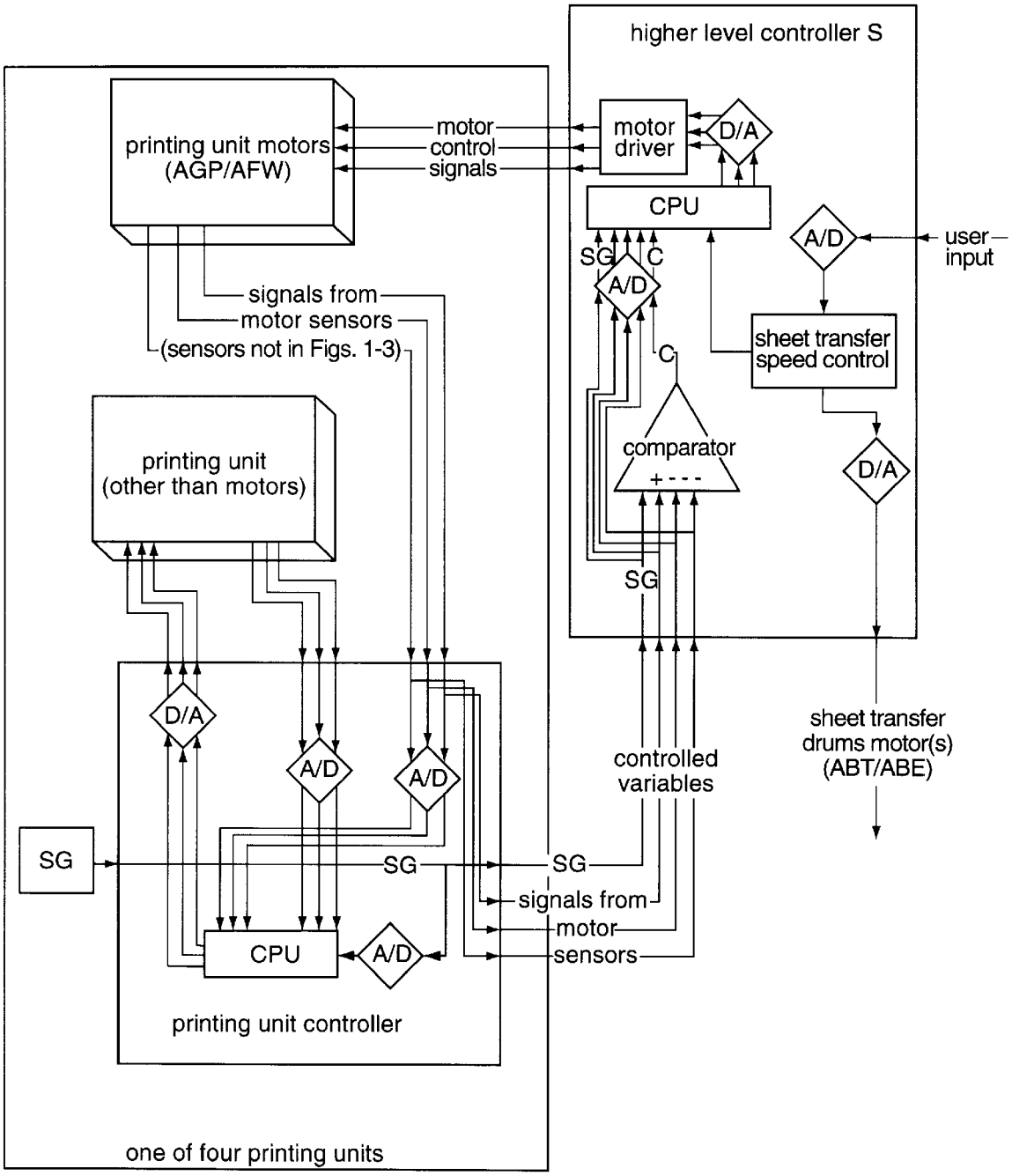
FIG. 4 is a schematic representation of the electronic control system for an embodiment which uses DC motors.
Figure 5:
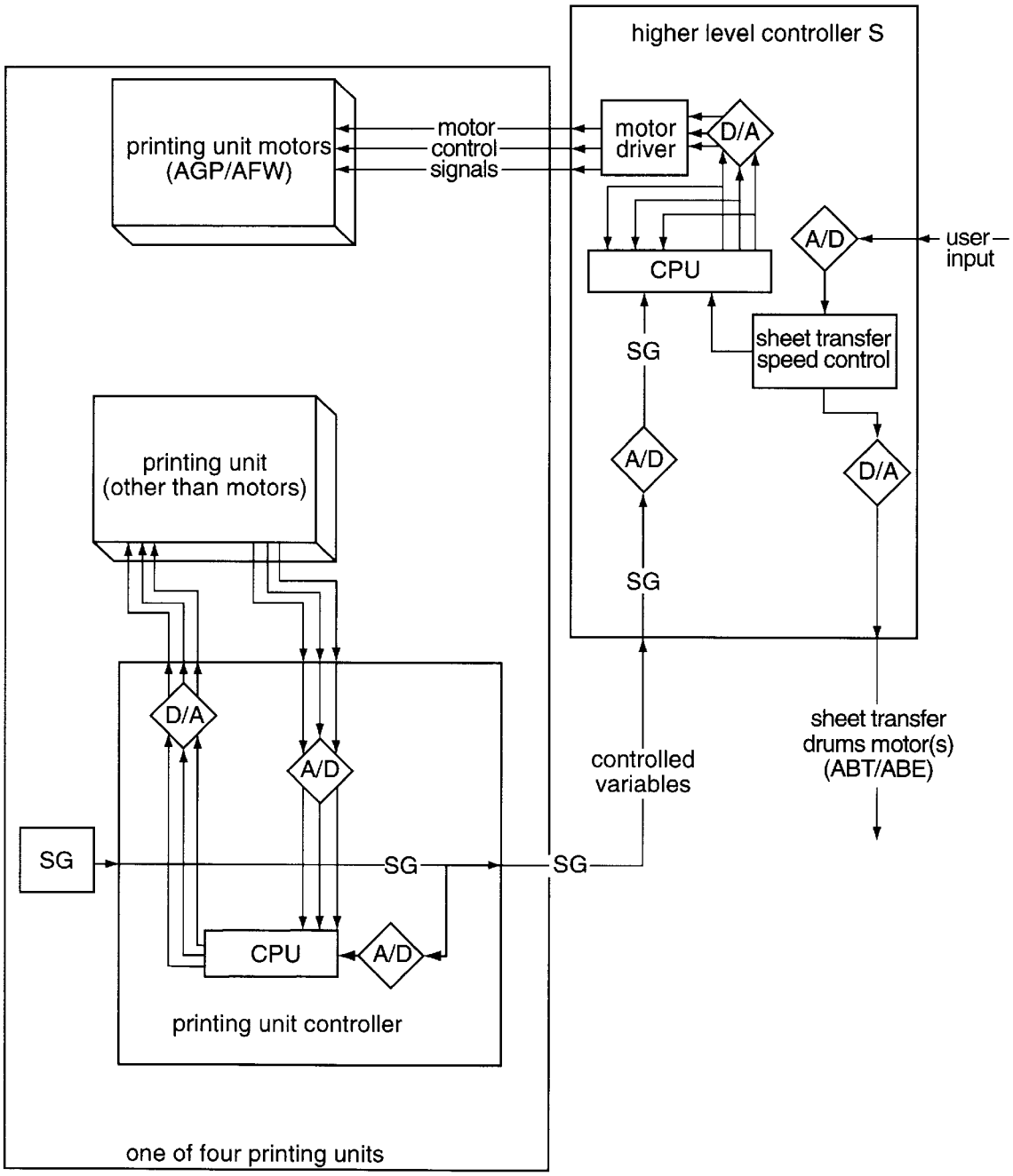
FIG. 5 is a schematic representation of the electronic control system for an embodiment which uses electronically controlled AC drives.

In the third exemplary embodiment as well, appropriate movement commands are stipulated by a higher-order controller S, which is also fed the signals of sensors (angle sensors/incremental encoders) as in FIG. 4. This exemplary embodiment provides an advantage in that the synchronism of the individual impression cylinder GT/transfer drum T systems in the printing units can be effected by a "virtual control axle", where the drives ABE assigned to the printing units are controlled to synchronism by the controller S stipulating appropriate movement commands/kinetic quantities. In this case, remaining deviations of the actual positions as detected by the sensors are then controlled with respect to the stipulated movements in accordance with the virtual control axle.

The second and third exemplary embodiments can further provide that the drive of the impression cylinders GD and of the transfer cylinders T cooperating therewith or coupled thereto is performed in the individual printing units via the drives AG of the blanket cylinders G connected to the impression cylinders GD. In this case, the continuous or split-up sheet-transfer system GD, T has no dedicated drive ABT or no dedicated drives ABE.

What is claimed is:

1. A drive system for a sheet-fed offset printing press having a plurality of printing units, each unit having at least one printing cylinder and one sheet transfer cylinder, a gear train interconnecting the sheet transfer cylinders of the units, the drive comprising: at least one sheet transfer drive driving the gear train; a plurality of printing cylinder drives; at least one of the printing cylinder drives coupled to drive a respective one of the printing cylinders in each respective printing unit mechanically independently from the gear train; and means for controlling the sheet transfer drive and the plurality of printing unit cylinder drives in a prescribable fashion.

2. A drive according to claim 1, wherein each printing unit includes: a plate cylinder; a blanket cylinder selectively positionable to roll against the plate cylinder; and an impression cylinder coupled by gears to the blanket cylinder and positioned to roll against the blanket cylinder; a plate cylinder drive coupleable to drive the plate cylinder in a manner mechanically decoupled from the associated blanket cylinder.

3. A drive according to claim 2, further comprising a plurality of blanket cylinder drives, each of the blanket cylinder drives being drivably coupleable to a respective one of the blanket cylinders to apply a braking torque to the respective blanket cylinder in a manner to effect a generally constant torque transfer in said gear train.

4. A drive according to claim 2, wherein said at least one sheet transfer drive includes a plurality of blanket cylinder drives, said impression cylinders being respectably engageable with said blanket cylinders to be drivable by the blanket cylinder drives.

5. A drive according to claim 1, wherein said at least one printing cylinder in each of said printing units includes a plate cylinder, a blanket cylinder, and at least one gear pair, the plate cylinder being drivably coupled to the blanket cylinder by the at least one gear wheel pair in each respective unit, and wherein each of said printing cylinder drives is a drive coupleable to drive one of the blanket cylinders in a manner mechanically decoupled from said sheet transfer cylinders.

6. A drive according to claim 1 wherein said gear train interconnecting said sheet transport cylinders of said plurality of printing units is constantly coupled.

7. A drive according to claim 1, wherein said means for controlling includes means for respectively driving one of the printing cylinders of each of said printing units to correct circumferential register deviations with respect to other cylinders.

8. A drive according to claim 1, wherein said means for controlling includes means for respectively driving one of the printing cylinders of each of said printing units to correct printing length deviations with respect to other cylinders.

9. A drive for a sheet-fed offset printing press having a plurality of printing units, each unit having at least one printing unit cylinder and a sheet transfer system, the sheet transfer system in each unit including an impression cylinder and transfer cylinder, a pair of gears rotatably coupling the impression cylinder and transfer cylinder in each unit, said impression cylinder and said transfer cylinder in each unit being mechanically uncoupled from the transfer systems of the other units, the drive comprising: a plurality of sheet transfer drives, at least one of the sheet transfer drives coupled to drive the sheet transfer system in each respective unit; a plurality of printing unit cylinder drives, at least one of the printing unit cylinder drives coupled to respectively drive one of the printing unit cylinders in each unit mechanically independently from the sheet transfer drives; and means for respectively controlling the plurality of sheet transfer drives and the plurality of printing unit cylinder drives in a prescribable fashion.

10. A drive according to claim 9, wherein said means for controlling includes means for respectively driving one of the printing cylinders of each of said printing units to correct circumferential register deviations with respect to other cylinders.

11. A drive according to claim 9, wherein said means for controlling includes means for respectively driving one of the printing cylinders of each of said printing units to correct printing length deviations with respect to other cylinders.

12. A drive system for a printing press, comprising: a sheet transport means; at least one drive driving said sheet transport means; a plurality of printing units, each printing unit including a plate cylinder a plate cylinder drive driving the plate cylinder mechanically decoupled from the sheet transport means and the ink vibrator roller; at least one distribution roller, an ink vibrator roller, a vibrator roller drive driving the ink vibrator roller mechanically decoupled from the sheet transport means and the plate cylinder; and a sheet transport means mechanically decoupled from the plate cylinder and the ink vibrator unit; and a control means for adjustably synchronizing the rotational speed of the various drives, including the plate cylinder drives, the vibrator roller drives, and the at least one sheet transport drive.

13. The drive of claim 12 wherein each printing unit further comprises: a blanket cylinder mechanically decoupled from the plate cylinder and mechanically coupled to the impression cylinder; a blanket cylinder drive providing torque to maintain constant contact in the coupling means between the blanket cylinder and impression cylinder; and a control means which synchronizes the blanket cylinder and plate cylinder by adjusting the rotational speed of the blanket cylinder drive and the plate cylinder drive.

14. The drive of claim 12 wherein said sheet transport means include a plurality of separately driven sheet transport sections, each printing unit having one sheet transport section, wherein each such printing unit and an associated sheet transport section are mechanically decoupled from other other said printing units, and wherein the transport sections are synchronized by a control means which adjusts the rotational speed of each transport section drive.

15. The drive of claim 14 wherein said synchronization of the sheet transport eleiminates any deviations from stipulated movement.

16. The drive of claim 12 wherein the control means is operable to correct a rotation in one of said cylinders in a circumferential direction by electronically prescribing a phase shift in the synchronism between the impression cylinder and the plate cylinder.

17. The drive of claim 12 wherein the control means is operable to control said arises to adjustably compensate for a printing length.

18. The drive of claim 12 wherein said mechanical decoupling in said printing units permits plate removal during operation of said printing press.

* * * * *